US011219249B2

(12) United States Patent
Brandy

(10) Patent No.: US 11,219,249 B2
(45) Date of Patent: Jan. 11, 2022

(54) ADJUSTABLE STRAP FOR A GARMENT

(71) Applicant: Jewel Brandy, Bellwood, IL (US)

(72) Inventor: Jewel Brandy, Bellwood, IL (US)

( * ) Notice: Subject to any disclaimer, the term of this patent is extended or adjusted under 35 U.S.C. 154(b) by 35 days.

(21) Appl. No.: 16/557,127

(22) Filed: Aug. 30, 2019

(65) Prior Publication Data

US 2021/0059324 A1 Mar. 4, 2021

(51) Int. Cl.
*A41D 3/02* (2006.01)

(52) U.S. Cl.
CPC ..... *A41D 3/02* (2013.01)

(58) Field of Classification Search
CPC . A41D 27/22; A41D 3/02; A41D 1/00; A41D 2400/48; A41D 19/0041; A41D 1/005; A41D 13/0012; A41D 13/0568; A41D 1/04; A45F 5/02; A45F 3/14; A45C 13/30
USPC ..... 2/144, 85, 69, 93, 247
See application file for complete search history.

(56) References Cited

U.S. PATENT DOCUMENTS 277,527 A * 5/1883 Williams ..... A41D 1/04 2/115
388,123 A * 8/1888 Cohen ..... A41D 1/02 2/93
640,731 A * 1/1900 Abrams ..... A41D 1/04 2/115
703,751 A * 7/1902 Adams ..... A41D 1/04 2/115
831,172 A * 9/1906 Ma Loney ..... A41D 1/04 2/115
902,084 A * 10/1908 Hyltén-Cavallius ..... A41D 1/04 2/102
912,229 A * 2/1909 Bursteen ..... A41D 3/02 2/85
1,029,828 A * 6/1912 Schwartz ..... A41D 1/04 2/102
1,061,945 A * 5/1913 Oppenheimer ..... A41D 1/02 2/93
1,198,059 A * 9/1916 Ross ..... A41D 13/0012 2/94
1,218,941 A * 3/1917 Hodes ..... A41D 1/04 2/102
1,243,828 A * 10/1917 Freedman ..... A41D 1/04 2/102

(Continued)

FOREIGN PATENT DOCUMENTS

CA 2551522 C * 9/2013 ..... A62B 17/001
FR 322396 A * 2/1903 ..... A41D 27/22

(Continued)

OTHER PUBLICATIONS

Buckle. (2020). Retrieved from https://www.merriam-webster.com/dictionary/buckle (Year: 2020).*

*Primary Examiner* — Heather Mangine
*Assistant Examiner* — Raquel M. Weis
(74) *Attorney, Agent, or Firm* — Quarles & Brady LLP

(57) ABSTRACT

A strap includes an elastomeric portion and three loci, with the first locus and the second locus being permanently attached to a garment and the third locus being removably, selectively attached to the garment. The strap includes an elastomeric portion and is configured to selectively include two pathways or one pathway, so as to retain a fabric member between a rear surface of the strap and the liner of the garment.

12 Claims, 6 Drawing Sheets

(56) References Cited

U.S. PATENT DOCUMENTS 1,520,963 A * 12/1924 Nyilas ..... A47G 9/062 2/89
1,629,840 A * 5/1927 Rolnick ..... A41D 3/02 2/91
1,787,216 A * 12/1930 Spielberger ..... A41D 1/04 2/102
1,849,628 A * 3/1932 Lemercier ..... B64D 17/30 244/143
1,902,939 A * 3/1933 Adler ..... A41D 1/04 2/102
2,019,993 A * 11/1935 Regal ..... A41D 3/02 2/93
2,067,850 A * 1/1937 Kaufman ..... A41D 1/04 2/102
2,119,378 A * 5/1938 Berger ..... A41D 1/04 2/90
2,146,243 A * 2/1939 Aug ..... A41D 15/04 2/85
2,226,486 A * 12/1940 Weisend ..... A41D 3/02 2/93
2,248,455 A * 7/1941 Freund ..... A41D 13/0012 2/94
2,257,935 A * 10/1941 Blagden ..... A41D 15/00 2/94
2,292,348 A * 8/1942 Bailey ..... A41D 1/02 2/97
2,398,258 A * 4/1946 Seegal ..... A41D 1/04 2/115
2,603,789 A * 7/1952 Straus ..... A41D 10/00 2/108
2,620,479 A * 12/1952 Buck ..... A41D 13/0012 2/94
2,661,474 A * 12/1953 Tate ..... A41D 13/0537 2/94
2,722,020 A * 11/1955 Gazelle ..... A41D 13/0012 441/92
2,920,328 A * 1/1960 Hammersley ..... A41D 27/18 2/98
3,755,822 A * 9/1973 Bobry ..... A41D 27/22 2/271
3,973,643 A * 8/1976 Hutchinson ..... A62B 35/0006 182/3
4,055,873 A * 11/1977 Kallman ..... A45F 5/02 24/3.3
4,068,314 A * 1/1978 Yellen ..... A41D 13/0012 2/94
4,106,121 A * 8/1978 Belson ..... A41D 13/0012 2/102
4,190,904 A * 3/1980 Nelson ..... A41D 25/027 2/137
4,213,548 A * 7/1980 Wood ..... A44C 5/0053 224/168
4,236,658 A * 12/1980 Kallman ..... A45F 5/00 224/250
4,261,059 A * 4/1981 Spitz ..... A41D 3/00 2/108
4,449,253 A * 5/1984 Hettinger ..... A41D 13/0007 2/93
4,639,980 A * 2/1987 Peterson ..... A61M 25/02 128/DIG. 14
4,682,671 A * 7/1987 Hengstenberger ..... A62B 35/0037 182/3
4,715,068 A * 12/1987 Jacobson ..... A41D 27/04 2/272
4,862,563 A * 9/1989 Flynn ..... A44B 18/00 24/442
4,885,805 A * 12/1989 Mason ..... A41D 27/08 2/244
4,932,574 A * 6/1990 Doshi ..... A41D 15/04 2/94
4,969,214 A * 11/1990 Cohen ..... G09F 21/02 2/94
4,998,654 A * 3/1991 Bruzek ..... A41D 13/0012 2/102
5,014,359 A * 5/1991 Hanson ..... A41D 13/0012 2/102
5,138,717 A * 8/1992 Tolton ..... A41D 1/04 2/123
5,247,707 A * 9/1993 Parker ..... A41D 13/0012 2/102
5,309,572 A * 5/1994 Seamans ..... A41F 5/00 2/107
5,370,113 A * 12/1994 Parsons ..... A41D 15/04 128/202.13
5,400,438 A * 3/1995 Staff ..... A41D 27/18 2/108
5,441,188 A * 8/1995 Rosenstein ..... A45F 3/12 224/264
5,450,627 A * 9/1995 Grilliot ..... A41D 13/0525 2/102
5,488,738 A * 2/1996 Seamans ..... A41F 5/00 2/112
5,507,042 A * 4/1996 van der Slessen .... A41D 27/28 2/69
5,611,084 A * 3/1997 Garry ..... A41D 13/0525 2/102
5,692,237 A * 12/1997 Bennett ..... A41D 13/0012 2/93
5,717,999 A * 2/1998 Lurry ..... A41D 15/002 2/108
6,128,782 A * 10/2000 Young ..... A62B 35/0037 2/69
6,212,688 B1 * 4/2001 Leslie ..... A41D 19/0041 2/160
6,233,740 B1 * 5/2001 Meyers ..... A41D 13/0007 2/102
6,279,804 B1 * 8/2001 Gregg ..... A45F 5/02 2/255
6,332,222 B1 * 12/2001 Graham ..... A41D 3/00 2/69
6,421,834 B2 * 7/2002 Kester ..... A41D 15/04 2/94
7,000,255 B1 * 2/2006 Baacke ..... A41D 3/00 2/94
7,117,539 B1 * 10/2006 Baacke ..... A41D 1/04 2/102
7,152,247 B2 * 12/2006 Parsons ..... A41D 3/00 2/94
7,165,271 B2 * 1/2007 Elen ..... A41D 3/00 2/301
7,168,103 B2 * 1/2007 Aldridge ..... A41D 13/02 2/458
7,451,531 B2 * 11/2008 Israel ..... A44B 11/006 24/442
7,571,494 B2 * 8/2009 Grilliot ..... A62B 35/0037 182/3
7,707,660 B2 * 5/2010 Grilliot ..... A62B 35/0025 2/455
7,823,221 B2 * 11/2010 Green ..... A61F 5/4408 2/114
7,971,272 B2 * 7/2011 Bailey ..... A41D 15/002 2/80
8,047,410 B2 * 11/2011 Holm ..... A47G 25/14 223/93
8,256,026 B2 * 9/2012 Garrigos ..... A41D 13/0002 2/94
8,430,204 B1 * 4/2013 Reynolds ..... A62B 35/0006 182/3
8,656,516 B1 * 2/2014 Reinhardt Rawlings ..... A47D 13/086 2/80
8,776,266 B1 * 7/2014 Metz ..... A41D 13/0007 2/94
8,782,813 B2 * 7/2014 Usami ..... A41F 9/00 2/96

(56) References Cited

U.S. PATENT DOCUMENTS 8,904,564 B2 * 12/2014 Laycock ..... A41D 19/0041 2/94
8,955,165 B1 * 2/2015 Romero ..... A41D 27/18 2/98
8,973,169 B2 * 3/2015 Curtis ..... A41D 13/0012 2/251
9,089,169 B1 * 7/2015 Covo ..... A41D 1/04
9,297,611 B1 * 3/2016 Roccisano ..... F41C 33/041
9,557,139 B1 * 1/2017 Miner ..... F41C 33/048
9,980,526 B2 * 5/2018 Silverberg ..... A41D 13/1209
10,034,502 B2 * 7/2018 Elliott ..... A41D 19/0041
10,653,231 B2 * 5/2020 Gordon ..... F41C 33/048
10,791,775 B2 * 10/2020 Grogro ..... A41D 27/00
2001/0025384 A1 * 10/2001 Kester ..... A41D 15/04 2/89
2003/0213043 A1 * 11/2003 Lewis ..... A41D 13/0007 2/69
2004/0000332 A1 * 1/2004 Yang ..... A45B 11/04 135/15.1
2004/0172734 A1 * 9/2004 Hartbrodt ..... A45F 5/022 2/97
2005/0015844 A1 * 1/2005 Parsons ..... A41D 3/00 2/94
2006/0162049 A1 * 7/2006 Guerriero ..... A41D 27/00 2/244
2007/0192926 A1 * 8/2007 Fee ..... A62B 35/0037 2/81
2008/0164095 A1 * 7/2008 Snedeker ..... A62B 35/0006 182/3
2009/0205102 A1 * 8/2009 Anderson ..... A41D 3/00 2/85
2010/0287681 A1 * 11/2010 Storms, Jr ..... F41H 1/02 2/102
2015/0000004 A1 * 1/2015 Silverberg ..... A41D 13/0058 2/69
2015/0026862 A1 * 1/2015 Silverberg ..... A41D 13/1209 2/69
2015/0189931 A1 * 7/2015 Elliott ..... A41D 19/0041 2/336
2016/0044976 A1 * 2/2016 Nykoluk ..... A41D 13/0568 2/2.5
2016/0135517 A1 * 5/2016 Silverberg ..... A41D 13/005 2/93
2017/0105471 A1 * 4/2017 Horner ..... A41D 1/04
2017/0238641 A1 * 8/2017 Chapman ..... A61J 17/1115
2017/0281989 A1 * 10/2017 Wood ..... A62B 35/0043
2017/0295913 A1 * 10/2017 Gaskin ..... A45F 4/02
2017/0311656 A1 * 11/2017 Forko ..... A47G 25/90
2017/0354530 A1 * 12/2017 Shagdar ..... A41D 13/0015
2018/0368602 A1 * 12/2018 Albanese ..... A44B 99/00
2019/0059462 A1 * 2/2019 Grogro ..... A41D 31/02
2019/0166926 A1 * 6/2019 Doroski ..... A61G 7/1038

FOREIGN PATENT DOCUMENTS

GB 2486907 A * 7/2012 ..... A41D 27/22
WO WO-2010009843 A1 * 1/2010 ..... A41D 1/02
WO WO-2016007385 A1 * 1/2016 ..... A41D 13/0058

* cited by examiner

ADJUSTABLE STRAP FOR A GARMENT

CROSS REFERENCE TO RELATED APPLICATIONS

Not applicable

REFERENCE REGARDING FEDERALLY SPONSORED RESEARCH OR DEVELOPMENT

Not applicable

SEQUENCE LISTING

Not applicable

BACKGROUND OF THE INVENTION

1. Field of the Invention

The present disclosure relates generally to an adjustable strap for retaining accessories within a garment.

2. Description of the Background of the Invention

A variety of garments, such as coats, are worn by users who also have a need for accessories. Such accessories may include scarves, gloves, hats, and the like. In some instances, users may store these accessories in a pocket or pockets within the garment. However, due to the shape and size of such accessories, storage in a pocket or pockets may be limited or inconvenient. Additionally, such accessories may become dislodged from the pocket or pockets, causing them to be lost as a result. Moreover, children or seniors using garments and accessories like these may forget in which pocket or pockets the accessories are stored. Even worse, such users may not store the accessories at all, allowing them to be placed apart from the garment.

Therefore, what is needed is a garment that preferably addresses one or more of these concerns.

SUMMARY

In one aspect of the disclosure, a strap includes an elastomeric portion and three loci, the first locus and the second locus being permanently attached to a garment and the third locus being removably, selectively attached to the garment. The strap is configured to selectively include first and second pathways or a single pathway. The third locus is removably, selectively attached by a hook and loop fastener mounted to a rear surface of the strap, the rear surface of the strap being arranged to face the garment, and the hook and loop fastener defining an inner boundary for the first and second pathways. In some embodiments, the first and second loci of the strap are permanently attached by stitching. The first and second loci of the strap define first and second outer boundaries for the first and second pathways and the single pathway. Further, the garment may include first and second armholes, a liner, a collar, and a back panel. The strap may include a length greater than a width. The first and second pathways are positioned adjacent and parallel to each other along the length of the strap. The elastomeric portion of the strap assists in retaining a fabric member between the strap and the liner, the fabric member being retained in either the first pathway or the second pathway or both. The strap is disposed equidistant from the first and second arm holes and at a distance below the collar. In some aspects, the distance is approximately 100 to 178 millimeters. In other embodiments, the strap further includes a buckle for removably, selectively attaching accessories thereto.

In another aspect, a system includes a strap mounted inside a garment. The garment further includes an interior layer disposed adjacent an exterior layer, a pair of arm receptacles positioned between an upper edge and lower edge of the garment, and a loop disposed below a collar of the garment. The strap further includes an elastomeric portion, a front surface and a rear surface, and a midpoint and two lateral ends. The rear surface of the strap is removably, selectively coupled to the interior layer of the garment near the midpoint of the strap and permanently coupled to the exterior layer of the garment near the lateral ends. The strap is positioned between the pair of arm receptacles and below the loop of the collar. Additionally, the strap receives a fabric member adjacent the rear surface. In some embodiments, the strap includes a buckle for removably, selectively attaching accessories thereto. The elastomeric portion of the strap causes the fabric member to be retained between the rear surface and the interior layer. Further, the strap may selectively include two pathways or one pathway.

In still another aspect, an elastomeric strap includes first and second lateral ends, a medial portion equidistant from the two lateral ends, and a front surface and a rear surface. The rear surface is attached to both a liner of a garment a back panel of the garment. The rear surface is configured to be removably, selectively attached to the liner at a midpoint of the strap. Further, stitching permanently attaches the strap to the back panel of the garment, the stitching extending through the front and rear surfaces of the strap, the liner, and the panel. A compressive force exists between the rear surface and the liner, and the elastomeric strap further includes a closed state wherein a first pathway is formed between the first lateral end and the medial portion, a second pathway is formed between the second end and the medial portion, and the first and second pathways are parallel to each other. The elastomeric strap further comprises an open state wherein the rear surface is detached from the liner. The elastomeric strap is positioned between a pair of arm holes and below a collar of the garment. Additionally, in some embodiments, the elastomeric strap retains a fabric member having no ends.

In yet another aspect, a garment includes an inner layer and an outer layer, a pair of arm portions, and a collar. The inner layer and the outer layer are attached at a periphery of the outer layer. The arm holes are positioned equidistant from the collar. The collar is positioned above the arm holes. A strap is directly attached to the inner layer between the arm portions and below the collar. The strap includes at least two permanent fasteners and at least one removable fastener. The permanent fasteners attach the strap to the outer layer, while the removable fastener attaches the strap to the inner layer. The strap is made of fabric, and the permanent fasteners are stitches. The removable fastener is a hook and loop fastener. The strap is capable of stretching via the elastomeric to receive a fabric member, such as double-ended scarf, an infinity scarf, a tie, an ascot, a hat, a strap for winter eyewear, an undergarment, or the like. The strap may be adjusted using the removable fastener, so as to permit a fabric member to be removed or retained.

Figure 1:
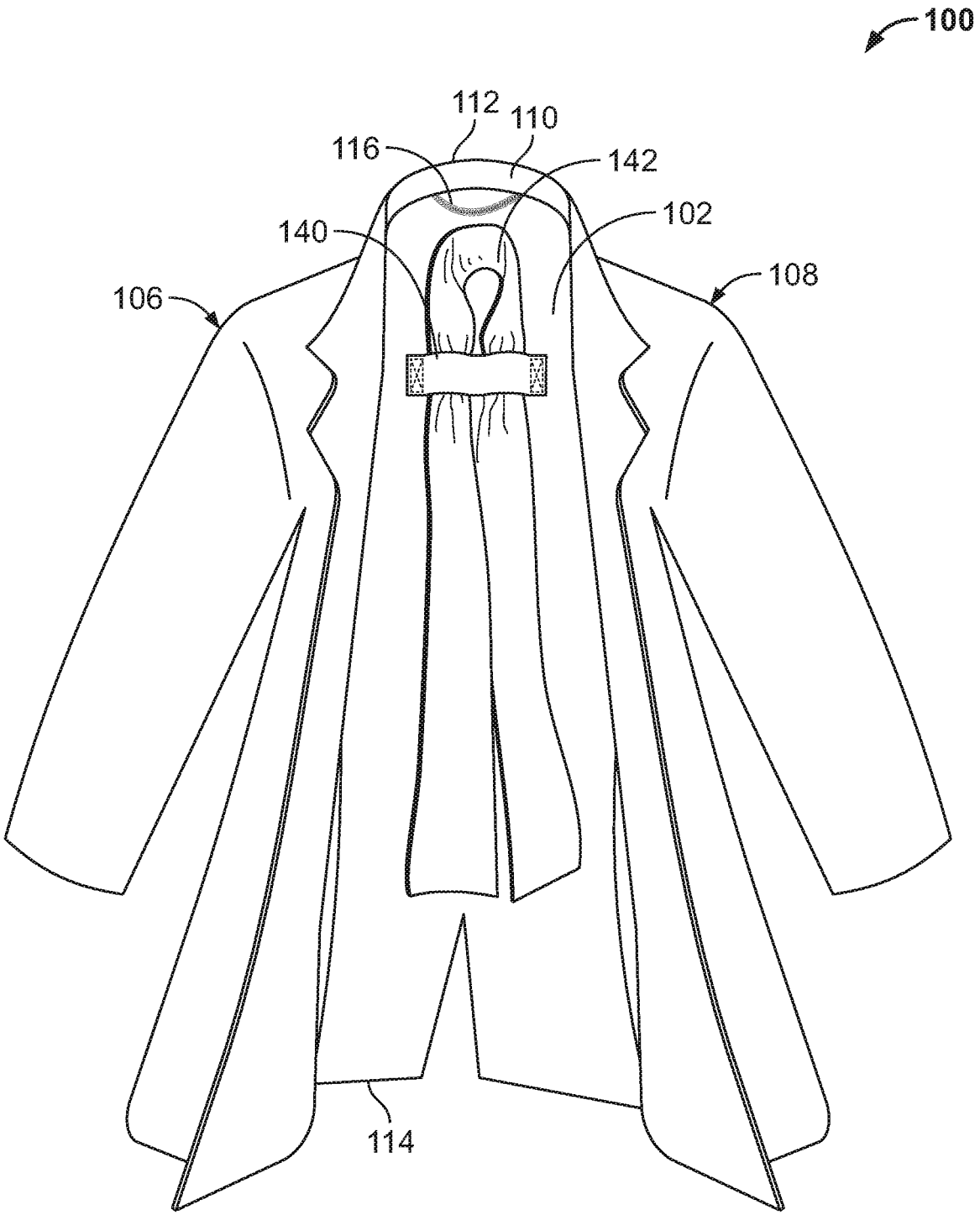
FIG. 1 is a front isometric view of a garment having a strap.

Other aspects and advantages of the embodiments described herein will become apparent upon consideration of the following detailed description, wherein similar structures have similar references numerals.

DETAILED DESCRIPTION OF THE DRAWINGS

The following discussion and accompanying figures disclose various embodiments or configurations of a garment and an adjustable strap disposed on the garment. Embodiments of the garment may, for example, include a coat or jacket, a pullover, a shawl, etc. Such concepts associated with embodiments of the garment and the adjustable strap may be applied to a wide range of apparel and styles, including wind-resistant garments, work-related garments, under garments, night garments, hiking or climbing garments, formal or dress garments, fashion garments, warm-weather garments, golf garments, ski and snowboard garments, soccer garments, walking garments, and track garments, for example. Concepts of the garment or the adjustable strap may also be applied to articles of clothing that are considered non-athletic or non-performance, including formal garments. Even further, particular concepts described herein may be incorporated in backpacks, suitcases, luggage, sports bags, purses, or other consumer or industrial products. Accordingly, concepts described herein may be utilized in a variety of products.

The present disclosure is directed to a garment, such as a coat, jacket, shawl, robe, or similar garments configured to promote user comfort in a variety of environments, and further including the adjustable strap disposed on the garment. The garment, adjustable strap, or portions thereof may comprise a knitted component, a woven textile, a non-woven textile, leather, mesh, suede, and/or a combination of one or more of the aforementioned materials. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The garment, adjustable strap, or portions thereof may comprise a variety of materials, such as a first yarn, a second yarn, and/or a third yarn, which may have varying properties or varying visual characteristics.

With reference to the material(s) that comprise the adjustable strap, the specific properties that a particular type of yarn will impart to an area of a knitted component may at least partially depend upon the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

The claimed subject matter may be embodied in other ways, may include different elements of steps, and may be used in conjunction with other existing or future technologies. The term "about," as used herein, refers to variation in the numerical quantity that may occur, for example, through typical measuring and manufacturing procedures used for articles of clothing or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes.

Figure 3:
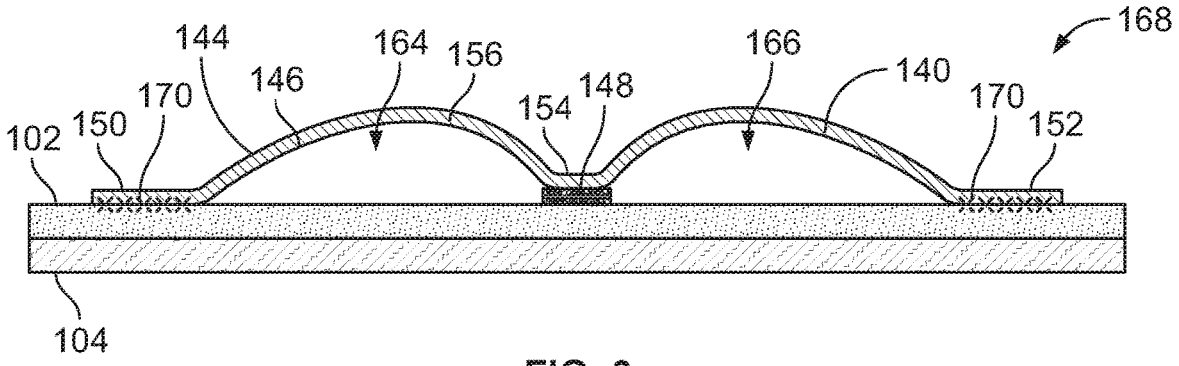
FIG. 3 is a sectional view of the strap of FIG. 1 in a closed state taken along the lines 3-3 of FIG. 2.

With reference to FIG. 1, in one aspect, a garment 100 includes an inner layer or liner 102 and a back panel 104. The back panel 104 may alternatively be defined as an exterior layer. The liner 102 may be a continuous piece of fabric that is attached along its perimeter to the back panel 104. The garment 100 includes first and second arm holes 106, 108 that permit a user's right and left arms to be inserted therethrough. The first and second arm holes 106, 108, or receptacles, are positioned below and equidistant from a collar 110 of the garment 100. The liner 102 and the back panel 104 extend between the first and second arm holes 106, 108. The liner 102 and the back panel 104 are preferably arranged to fit around a user's back, allowing for both thermal insulation and breathability. Accordingly, the liner 102 and the back panel 104 may be disposed adjacent to each other, as illustrated in FIG. 3. In this manner, air may become trapped between the liner 102 and the back panel 104 while also transferring therethrough. The garment 100 includes an upper edge 112 and a lower edge 114, with the first and second arm holes 106,108 positioned therebetween. The garment 100 can include a loop 116, for example, disposed below the collar 110 and the upper edge 112 but above the first and second arm holes 106, 108. The loop 116 can be used for hanging or storing the garment 100. As such, the loop 116 may be made of a fabric, metal, leather, synthetic material, or the like.

Figure 2:
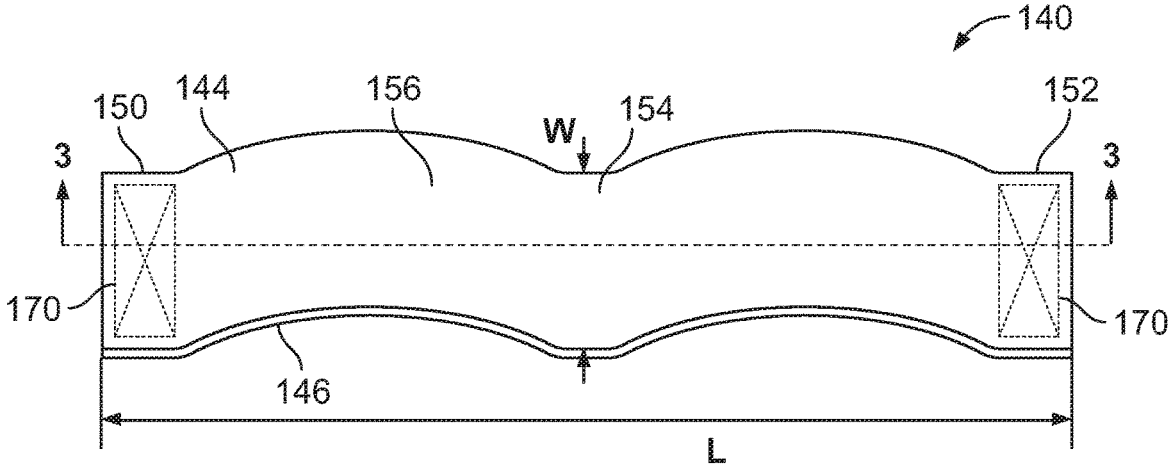
FIG. 2 is a front isometric view of the strap of FIG. 1 in a closed state.

Still referring to FIG. 1, a strap 140 is positioned between the first and second arm holes 106, 108 and below the collar 110. The strap 140 may be positioned equidistant from the first and second arm holes 106, 108 and at a distance below the collar 110. Accordingly, the strap 140 is positioned closer to the collar 110 than to the lower edge 114 of the back panel 104, such that the strap 140 is located between a user's shoulder blades when the garment is worn. The distance, in some embodiments, may be between about 100 mm and about 178 mm, or between about 120 mm and about 150 mm, or about 140 mm. Alternatively, the distance may be proportionate to a size of the garment 100 as adapted to a size of the user, which may range from an adult user to a child user. The strap 140 is configured to retain a fabric member 142, such as a scarf, between the strap 140 and the liner 102 or the back panel 104. The fabric member 142 may be formed so as not to have any ends, or to have one end, or even two ends. Still, the strap 140 may retain any such embodiment of the fabric member 142. For illustrative purposes, vertical axis Y and horizontal axis X are depicted in FIGS. 1 and 2. The vertical axis Y bisects the garment 100, being positioned centrally along the garment 100 approximately equidistant between the first and second armholes 106, 108, and defines a vertical plane that intersects the collar 110, the loop 116, and the lower edge of 114 of the garment 100. The horizontal axis X is positioned closer to the collar 110 than to the lower edge 114 of the garment 100 and defines a horizontal plane that intersects the first and second arm holes 106, 108. As illustrated in FIG. 1, the vertical axis X and the horizontal axis X are orthogonally disposed relative to each other.

Referring now to FIG. 2, the strap 140 includes a front surface 144 and a rear surface 146. The front surface 144 is arranged to face away from the liner 102 and the back panel 104. However, the front surface 144 may be permanently attached to the liner 102 and/or to the back panel 104, for example, by stitches fastened through the front surface 144, the rear surface 146, the back panel 104, and the liner 102. The rear surface 146 is arranged to face toward the liner 102 and the back panel 104, and may be selectively attached to the liner 102. In preferred embodiments, the rear surface 146 is permanently attached to the back panel 104 and/or liner 102 at opposite first and second lateral ends 150, 152 of the strap 140. The first and second lateral ends 150, 152 correspond with first and second loci. The rear surface 146 can additionally be removably and selectively attached to the liner 102 at a midpoint 154 of the strap 140, between the first and second lateral ends 150, 152. For example, the midpoint 154 of the rear surface 144 may be fastened using a hook-and-loop fastener 148, such as Velcro®, so as to permit selective attachment and to facilitate ease of use. The midpoint 154 of the strap 140 corresponds with a third locus. The strap 140, then, is attached to the liner 102 at three loci, the first locus and second locus being permanently attached and the third locus being removably and selectively attached. The vertical plane along the vertical axis Y, also shown in FIG. 1, intersects the midpoint 154 of the strap 140, and the first and second lateral ends 150, 152 are positioned on opposite sides of the vertical axis Y. In addition, the horizontal plane along the horizontal axis X, also shown in FIG. 1, intersects each the first and second lateral ends 150, 152 as well as the midpoint 154.

With continued reference to FIG. 2, the strap 140 has a length L and a width W, the length being greater than the width. The strap 140 further includes an elastomeric portion 156, such as elastomeric fibers or strands, operative to assist in retaining the fabric member 142 between the strap 140, particularly the rear surface 146 thereof, and the liner 102 and/or back panel 104. In this manner, a user may pull or stretch the strap 140 to position a fabric member 142 between the strap 140 and the liner 102 and/or back panel 104. Preferably, as shown in FIG. 3, a user would detach the midpoint 154 of the strap 140 to create a single pathway 160 between the rear surface 146 and the liner 102, causing the strap 140 to assume an open state 162. The single pathway 160 can receive the fabric member 142, such as by a user pulling or sliding the fabric member 142 through the single pathway 160. Then, the midpoint 154 of the strap 140 may be reattached to transform the single pathway 160 into first and second pathways 164, 166, causing the strap 140 to assume a closed state 168 as shown, for example, in FIGS. 2 and 4. The first pathway 164 exists between the first lateral end 150 and the midpoint 154, while the second pathway 166 exists between the second lateral end 152 and the midpoint 154. As such, the first and second pathways 164, 166 are parallel to each other. Because of the midpoint 154 being reattached to the liner 102, the fabric member 142 is inhibited from escaping or being dislodged from between the rear surface 146 of the strap 140 and the liner 102. Further, the elastomeric portion 156 of the strap 140 operates to retain the fabric member 142 by way of frictional resistance and a compressive force, which causes the fabric member 142 to be retained and secured against external forces, such as the garment 100 being dropped on floor or an exposed portion of the fabric member 142 being pulled. In this manner, the strap 140 may retain the fabric member 142 that has no ends, one end, or even two ends.

Referring to FIG. 3, an embodiment is depicted including the hook and loop fastener 148 as separate portions attaching the midpoint 154 of the rear surface 146 to the liner 102. Preferably, the rear surface 146 of the strap 140 is adhesively attached to a portion of the hook and loop fastener 148. The first and second pathways 164, 166 are also depicted as being separated by the hook and loop fastener 148. In this manner, the hook and loop fastener 148 defines a boundary between the first and second pathways 164, 166. Further, the first and second lateral ends 150, 152 are illustratively depicted as attaching the front surface 144 of the strap 140 to the back panel 104 through the liner 102 by stitches 170. The stitches 170 may extend along the entire width W of the strap 140, or some portion thereof. While some embodiments may utilize stitches 170 for such attachments, other embodiments may employ an alternative means of attachment, such as an adhesive, staples, clips, pins, buttons or the like.

Figure 4:
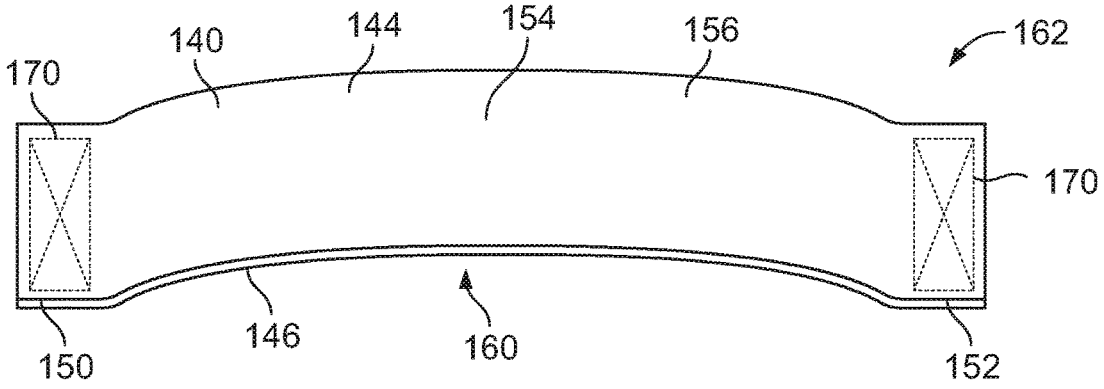
FIG. 4 is a front isometric view of the strap of FIG. 1 in an open state.

Still referring to FIG. 4, the first and second pathways 164, 166 are depicted as having substantially the same volume. However, the first and second pathways 164, 166 may have different volumes depending on the placement of the hook and loop fastener 148, the placement of the first and second lateral ends 150, 152 of the strap 140 on the garment 100, the operation of the elastomeric portion 156 of the strap 140, or even the shape of the strap 140 itself. Such a difference in volume may be desirable to retain various sizes, shapes, and styles of the fabric member 142, or to hold other accessories or items that may be pertinent to different seasons of weather, occasions, or other conditions.

Figure 5:
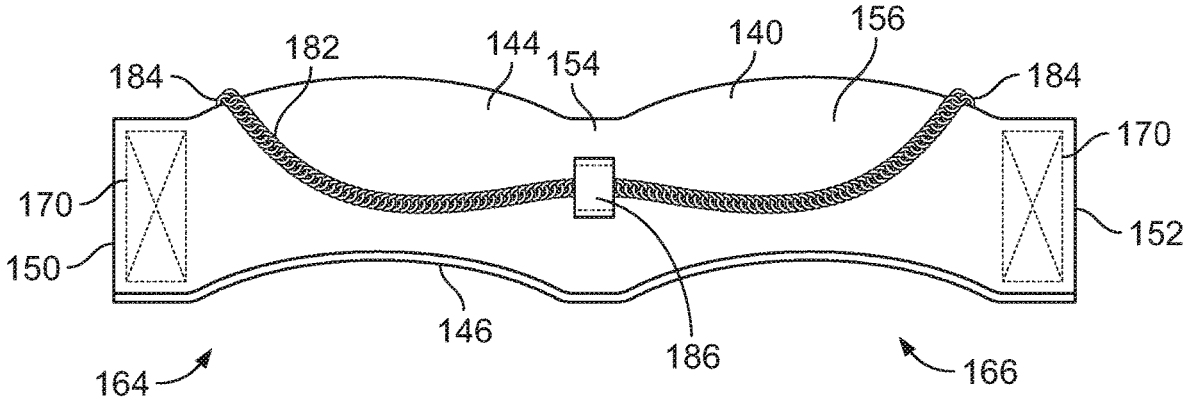
FIG. 5 is a front isometric view of another embodiment of a strap including a chain.

Referring now to FIG. 5, another embodiment of the strap 140 includes a chain 182. The chain 182 is draped along the front surface 144. Ends 184 of the chain 182 may be attached to the rear surface 146 of the strap 140, so as to be concealed. However, it is contemplated that the ends 184 may be attached to the front surface 144 or to another portion of the garment 100. The chain 182 may also be secured to the strap 140 near the midpoint 154, such as by a tag 186, for additional support and to secure the chain 182 more tightly to the strap 140. Other accessories, such as gloves, hats, scarves, and the like, may be removably, selectively attached to the chain 182 between its ends 184. In this manner, the strap 140 and the chain 182 may provide storage to a user having two or more accessories. Still better, the chain 182 may provide aesthetic value due to its ornate qualities. The chain 182 may be comprised of links, rings, clips, beads, or the like. Further, the chain 182 may include, for example, a string, twine, rope, leather, fabric, or elastomeric material. In some aspects, there may be more than one chain 182, or the chain 182 may be continuous, rather than having ends 184, as depicted in FIGS. 6-8.

Figure 6:
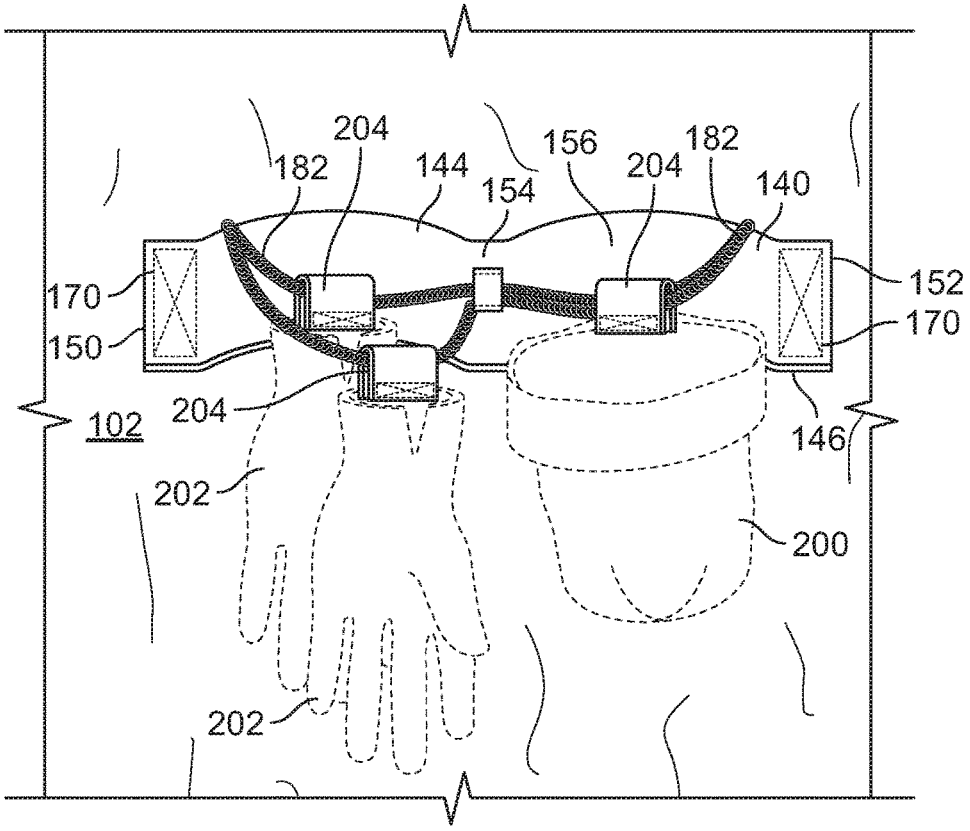
FIG. 6 is a front isometric view of another embodiment of the strap of FIG. 5 including a plurality of accessories removably attached thereto.
Figure 7:
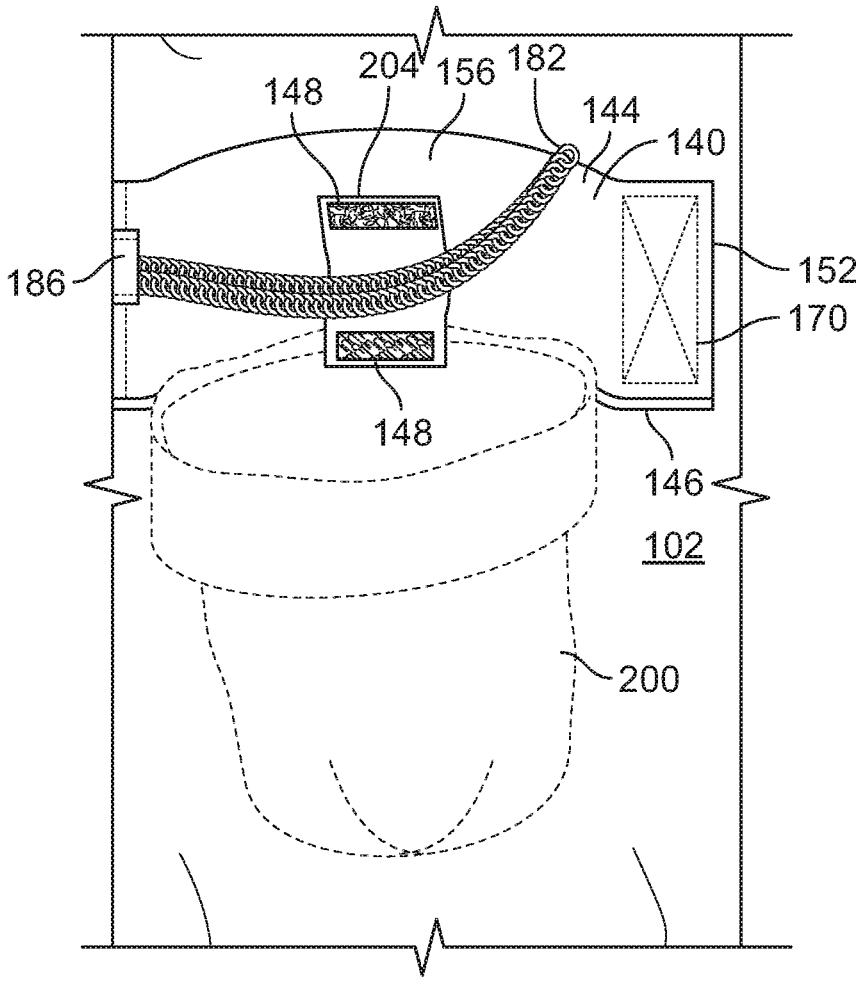
FIG. 7 is a front isometric view of a flap for an accessory, the flap being used to removably attach the accessory to a chain.

With reference to FIG. 6, an example of accessories including a hat 200 and a pair of gloves 202 may be attached to or along the chain 182. An attachment member, as depicted in FIG. 7, for example, may include a flap 204 made of fabric and employing hook and loop fasteners 148 thereon. The flap 204 may be attached to the accessories by stitching, or other types of fasteners. The flap 204 may resemble a rectangle, as illustrated in FIG. 7, or to resemble a circle, square, trapezoid, triangle, or even an irregular geometric shape. In any such embodiments of the flap 204, the hook and loop fasteners 148 are arranged at distance from each other and co-planar, i.e., on the same side, of the flap 204, such that when the flap 204 is folded the hook and loop fasteners 148 mate together. To remove the accessories, the hook and loop fastener 148 may be unfastened by grasping and pulling apart portions of the flap 204. In this manner, the accessories may be removably, selectively attached to the chain 182 for easier access when storing or retrieving the garment 100.

Figure 8:
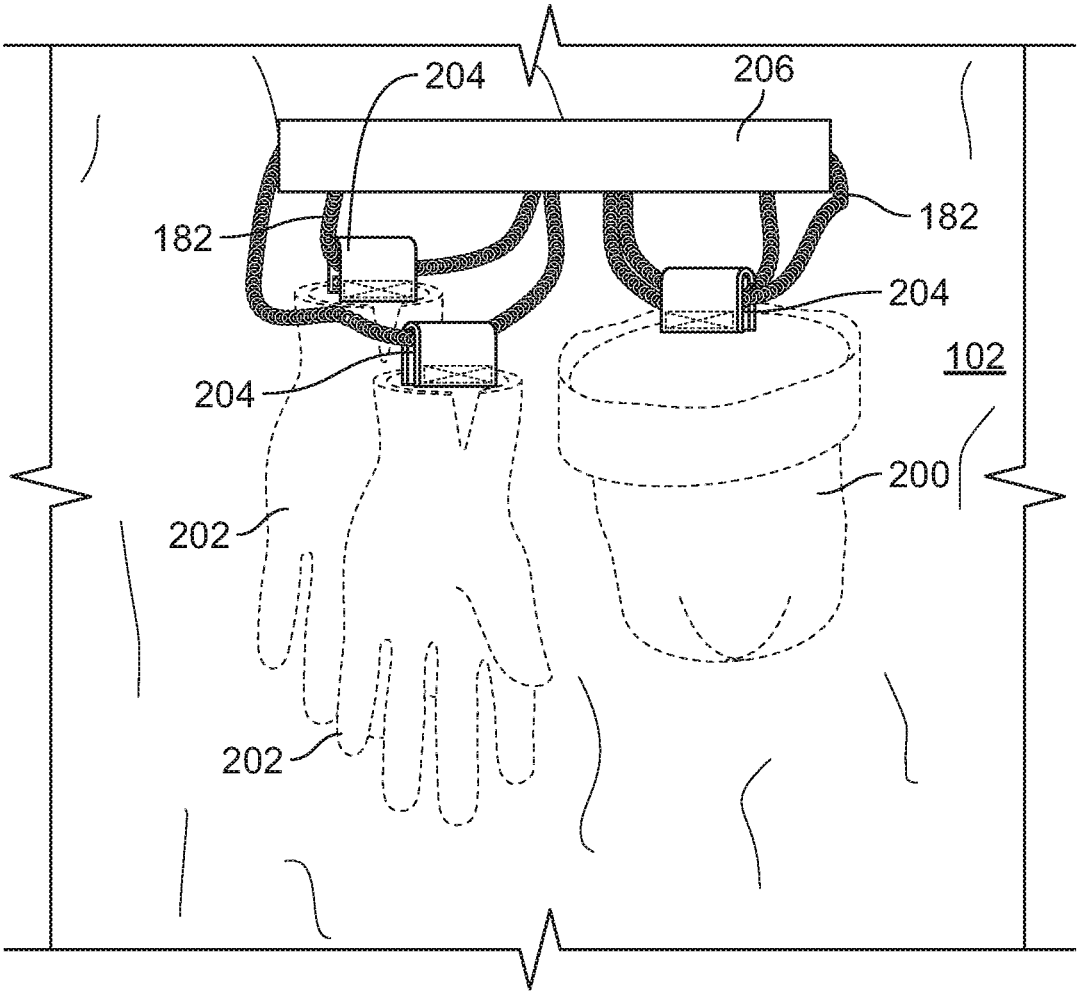
FIG. 8 is a front isometric view of yet another embodiment of a strap, further including a cover.
Figure 9:
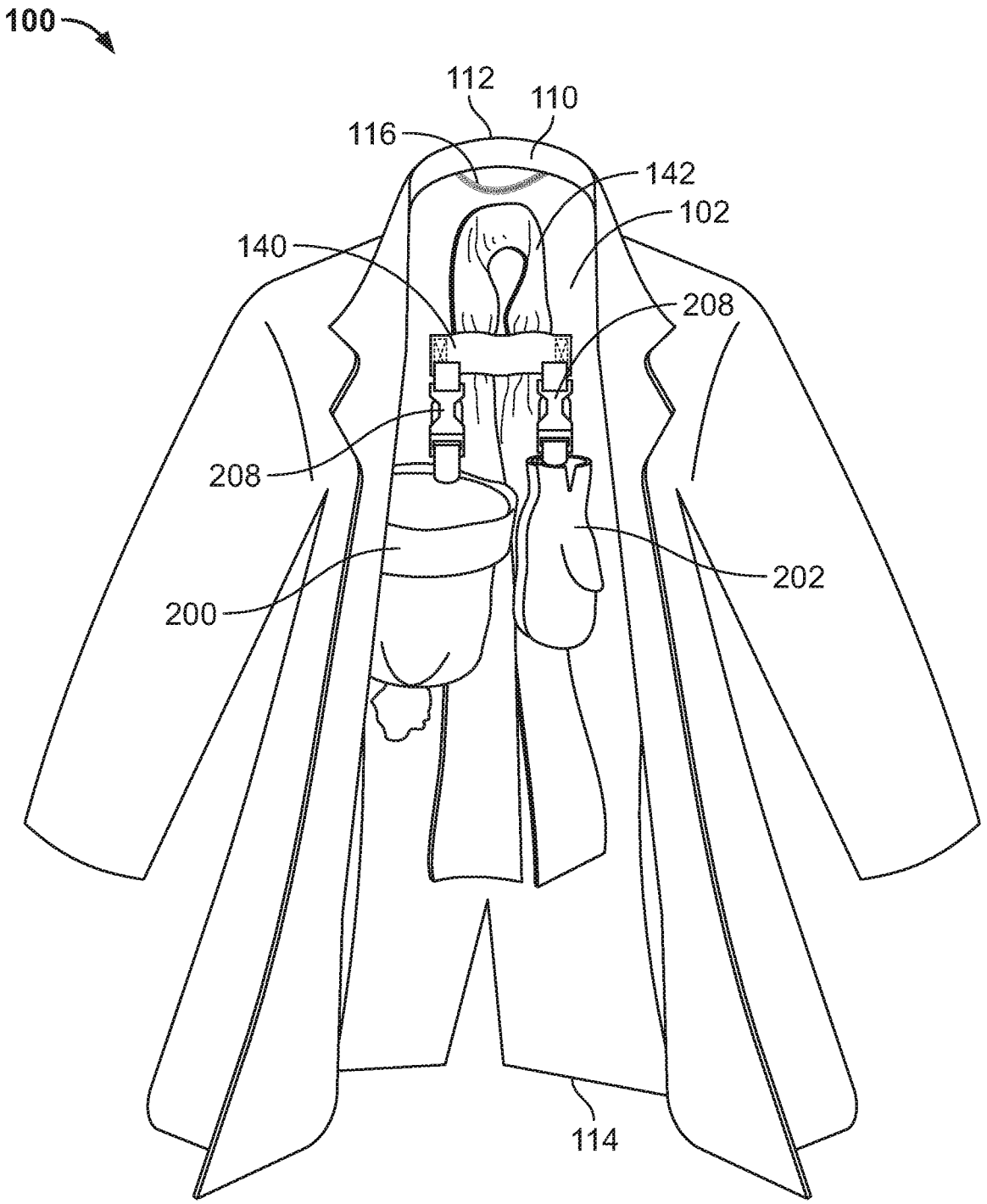
FIG. 9 is a front isometric view of still another embodiment of a strap including a plurality of accessories removably attached thereto.

Additionally, a cover 206 may be provided over the front surface 144 of the strap 140, as illustrated in FIG. 8. The cover 206 may be attached at the first and second lateral ends 150, 152 of the strap 140, or at additional locations therebetween, such as along a perimeter of the cover 206 and the strap 140. The cover 206 may be made of fabric, leather, synthetic fibers, and the like. As such, the cover 206 provides an aesthetic value due to its ornate qualities. Further, the cover 206 may include an elastomeric material, similar to the elastomeric portion 156 of the strap 140. In this manner, the cover 206 may stretch along with the strap 140 for ease of use. Now referring to FIG. 9, accessories may be removably, selectively attached to the strap 140 using alternative means, such as buckles 208. The buckles 208 may be fastened to the front surface 144 of the strap 140, for example, to facilitate access to them during storage or retrieval of the garment 100.

In some embodiments, the liner 102 may include discrete panels of fabric fastened together and to the back panel 104, such as in a diamond pattern or a quilted pattern. The liner 102 may be made of a fabric that is different from or the same as the fabric of the back panel 104. Preferably, the liner 102 is positioned to allow air to become trapped between the back panel 104 and the liner 102, promoting thermal insulation and also breathability. However, in some embodiments, there may be an insulating material disposed between the liner 102 and the back panel 104. The back panel 104 may be made of a fabric that is weather resistant, water resistant, wind resistant, or some combination thereof. In still other embodiments, any of the elements described, including the strap 140, the stitches 170, the chain 182, the tag 186, or the flap 204, may provide an aesthetic benefit to the garment 100, or even a source identifying feature, by the use of color, patterns, contrasting, arrangement, texture, or the like.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the invention and to teach the best mode of carrying out the same. The exclusive rights to all modifications which come within the scope of the appended claims are reserved.

I claim:

1. A garment comprising:

first and second armholes;

a collar;

a liner;

a back panel; and a strap having an elastomeric portion and three loci, a first locus and a second locus being permanently attached to the garment and a third locus being removably and selectively attached to the garment, wherein the strap is configured to selectively include first and second pathways or a single pathway, and wherein the strap further includes at least one buckle configured for removably and selectively attaching accessories thereto;

wherein each of the three loci of the strap is directly attached to the liner of the garment to form the first and second pathways when in use;

wherein the liner extends between the first and second arm holes and between the collar and a lower edge of the back panel; wherein the strap is positioned on the liner between the first and second armholes and closer to the collar than to the lower edge of the back panel, such that the strap is configured to be located between a user's shoulder blades when the garment is worn;

wherein a horizontal plane is configured to intersect each of the three loci of the strap and the first and second armholes; wherein a vertical plane is configured to intersect the collar and the third locus of the strap; wherein the vertical plane and the horizontal plane are orthogonally disposed relative to each other;

and wherein the first locus and the second locus are configured to be positioned on opposite sides of the vertical plane.

2. The garment of claim 1, wherein the third locus is removably and selectively attached to the liner of the garment by a hook and loop fastener mounted to a rear surface of the strap and the liner of the garment; the rear surface of the strap being arranged to face the garment, and the hook and loop fastener defining an inner boundary for the first and second pathways.

3. The garment of claim 2, wherein the first and second loci of the strap are permanently attached by stitching to the liner of the garment, and the first and second loci of the strap define a first and second outer boundaries for the first and second pathways and the single pathway.

4. The garment of claim 1, wherein the strap is disposed equidistant from the first and second armholes and at a distance below the collar, the distance being between 100 and 178 millimeters.

5. The garment of claim 1, wherein the elastomeric portion of the strap is configured to assist in retaining a fabric member between the strap and the garment, the fabric member configured to be retained in either the first pathway or the second pathway or both pathways.

6. The garment of claim 1, wherein the strap includes a length greater than a width, the first and second pathways being positioned adjacent and parallel to each other along the length of the strap when in use.

7. The garment of claim 1, wherein the buckle is fastened to a front surface of the strap.

8. A system comprising:

a strap attached inside a garment, the garment further comprising:

an interior layer disposed adjacent an exterior layer;

a pair of arm receptacles positioned between an upper edge and a lower edge of the garment, wherein a horizontal plane is configured to intersect the pair of arm receptacles; and a loop disposed below a collar on the inside of the garment, wherein a vertical plane that is located centrally along the garment and orthogonally disposed relative to the horizontal plane is configured to intersect the collar and the loop; and the strap further comprising:

an elastomeric portion;

a front surface and a rear surface; and a midpoint and two lateral ends;

wherein the rear surface of the strap is configured to removably and selectively couple to the interior layer of the garment near the midpoint of the strap and permanently couple to the interior layer of the garment near the lateral ends;

wherein the midpoint of the strap is configured to be intersected by the vertical plane, the two lateral ends of the strap are each configured to be intersected by the horizontal plane, and the strap is positioned between the pair of arm receptacles and below the loop of the collar; and wherein the strap receives a fabric member adjacent the rear surface when in use.

9. The system of claim 8, wherein the strap further includes a buckle for removably and selectively attaching accessories thereto.

10. The system of claim 8, wherein the elastomeric portion of the strap causes the fabric member to be retained between the rear surface and the interior layer when in use.

11. The system of claim 8, wherein the strap may selectively include two pathways or one pathway when in use.

12. The system of claim 8, wherein a chain is disposed along the front surface of the strap, the chain being configured to removably and selectively attach accessories thereto, and wherein the chain drapes along the front surface of the strap and has ends that are attached to the rear surface of the strap.

* * * * *